US005880399A

United States Patent [19]

Hales et al.

[11] Patent Number: 5,880,399

[45] Date of Patent: Mar. 9, 1999

[54] CAST EXPLOSIVE COMPOSITION WITH MICROBALLOONS

[75] Inventors: Richard H. Hales, West Jordan; Don H. Cranney, South Jordan, both of Utah

[73] Assignee: Dyno Nobel Inc., Salt Lake City, Utah

[21] Appl. No.: 892,127

[22] Filed: Jul. 14, 1997

[51] Int. Cl.[6] ..... C06B 45/18; C06B 29/08

[52] U.S. Cl. ..... 144/3; 149/2; 149/77; 149/83

[58] Field of Search ..... 149/2, 18, 77, 149/3, 83

[56] References Cited

U.S. PATENT DOCUMENTS

| | | | |
|---|---|---|---|
| 3,390,029 | 6/1968 | Preckel . | |
| 3,617,402 | 11/1971 | Knight . | |
| 3,684,594 | 8/1972 | Evans . | |
| 3,985,593 | 10/1976 | Machacek | 149/62 |
| 4,207,125 | 6/1980 | Grant . | |
| 4,398,976 | 8/1983 | Hattori et al. | 149/77 |
| 4,547,234 | 10/1985 | Takeuchi et al. | 149/77 |
| 4,554,032 | 11/1985 | Hattori et al. | 149/77 |
| 4,600,450 | 7/1986 | Jessop et al. | 149/77 |
| 4,693,765 | 9/1987 | Stromquist et al. . | |
| 4,820,361 | 4/1989 | McKenzie et al. . | |
| 5,007,973 | 4/1991 | Trapp et al. . | |
| 5,665,938 | 9/1997 | Stormquist et al. | 149/77 |

FOREIGN PATENT DOCUMENTS

| | | |
|---|---|---|
| 92/8660 | of 0000 | South Africa . |

*Primary Examiner*—Edward A. Miller

[57] ABSTRACT

The invention comprises a cap-sensitive, cast, solid explosive composition usable as a booster or primer and as a seismic explosive composition. The cast, solid explosive composition contains dispersed microballoons which impart important and surprising advantages.

8 Claims, No Drawings

CAST EXPLOSIVE COMPOSITION WITH MICROBALLOONS

The invention relates to an explosive composition that is cap-sensitive and is in a cast, solid form. More particularly, the invention relates to a cap-sensitive, cast, solid explosive composition usable as a booster or primer and as a seismic explosive in both normal and small sizes.

BACKGROUND OF THE INVENTION

Most cap-sensitive, cast, solid explosive compositions usable as primers are made from molecular explosives such as PETN, TNT, RDX or combinations thereof such as pentolite and composition B. These molecular explosives products have relatively high densities (1.60 g/cc or greater) and are formed from liquid melts at high temperatures. The high temperature liquid melts are poured into containers and allowed to cast upon cooling to the desired solid form. The melting, pouring and casting steps involve inherent hazards due to the high temperatures involved and the presence of molecular explosives. Recently, a novel cast, solid explosive composition was invented that allows mixing, pouring and casting of non-explosive ingredients to occur at ambient temperatures. The ingredients simply are admixed at ambient temperature to form a slurry that can be poured into containers and allowed to cure with time into a cap-sensitive, cast, solid form. (See co-pending U.S. Ser. No. 08/201,341.) In fact, when the non-explosive ingredients first are mixed together at ambient temperature, the mixture typically is not cap-sensitive, but upon curing, also at ambient temperature (except for the temperature rise due to heat of hydration and solvation as described below), the mixture casts and increases in sensitivity to become cap-sensitive. The inherent safety advantages of these compositions are obvious. Not only are non-explosive ingredients admixed at ambient rather than elevated temperatures, but also the composition increases in sensitivity only after the mixing step and simply upon being allowed to cure. These recent compositions comprise sodium perchlorate oxidizer salt, a polyhydric alcohol of low volatility such as diethylene glycol, and a small amount of water. The present invention is an improvement to these novel compositions, which hereafter will be referred to as "cast compositions."

Even though the cast compositions remain cap-sensitive and detonable at high densities (1.78 g/cc or higher), as do molecular explosives, the cast compositions tend to require greater run-up distances to reach terminal detonation velocity than molecular explosive-based compositions, which have short run-up distances. (Run-up distance is defined as the distance along the length of a cylindrical explosive charge that is required for the charge to reach its steady state or terminal detonation velocity, as measured from the point of initiation.) Also, these cast compositions have comparably higher critical diameters (unconfined) than do molecular explosives. (Critical diameter is defined as the minimum diameter at which a detonation wave is sustained in an explosive.) Further, as the diameter of the charge decreases, the detonation velocity of the cast compositions may decrease to a level (below about 5,000 m/sec) that is unacceptable. A shorter run-up distance, a smaller critical diameter and a higher terminal detonation velocity are preferred for booster and seismic charges. These characteristics are particularly important for small size (less than one pound) small diameter boosters or primers or minihole seismic explosives.

Another problem with the cast compositions as compared to molecular explosives involves impact sensitivity. The cast compositions can be more sensitive to impact initiation, depending on the impact stimulus, than molecular explosive products, and this difference in impact sensitivity can be a safety concern.

In summary, a need exists for the cast compositions to have shorter run-up distances, smaller critical diameters, higher terminal velocities in smaller diameters, and reduced impact sensitivity. The present invention satisfies these needs.

It has been found in the present invention that by adding a relatively small amount of microballoons and dispersing them throughout the cast composition, not only is the run-up distance decreased to a relatively very short distance (≦50 mm), but also the critical diameter is decreased to ≦0.5 inches. In addition, the impact sensitivity (to rifle bullet and air cannon initiation) is significantly reduced when a small amount of microballoons is added. This effect is surprising since normally the addition of microballoons or air voids to an explosive, even a molecular explosive, increases the detonation (and impact) sensitivity of the charge, particularly in charges having small critical diameters.

A possible explanation of this phenomenon in the present invention is that the microballoons act as "energy absorbers" in localized, decoupled regions within the explosive matrix, where the energy created by an impact is dissipated or interrupted before significant reaction of the ingredients takes place. The fact that the detonation run-up distance also is decreased seems to indicate that initiation sensitivity and impact sensitivity of these cast compositions occur by different mechanisms.

With respect to initiation sensitivity, once the detonation process has been initiated by a brisant, localized shock energy source (blasting cap), the microballoons facilitate propagation of the detonation wave such that it reaches its terminal velocity more quickly (shorter distance). The microballoons perform this function by serving as hot spots (adiabatically compressible gas pockets). For impact sensitivity, however, the microballoons prevent transition to detonation in the product by dissipating or interrupting the relatively low energy imparted by the impact source. In contrast, molecular explosives-based products tend to have excellent detonation properties (such as minimal run-up distance, small critical diameters and high velocities even in small charge diameters) at higher densities and do not need the presence of hot spots to help propagate the detonation wave.

Another property of the present cast composition is that the curing or casting time generally is reduced when plastic or glass microballoons are employed. This is advantageous since the overall manufacturing time can be reduced.

All of these described benefits combine to make the cast compositions useful for small booster (less than one pound) applications or minihole seismic explosives (one-third pound) applications, in which the products have short charge lengths and small diameters.

SUMMARY OF THE INVENTION

In summary, the present invention relates to the addition of microballoons to cast compositions to obtain the surprising and important advantages described above.

DETAILED DESCRIPTION OF THE INVENTION

The compositions of the present invention preferably comprise sodium perchlorate in an amount of from about 50% to about 80% by weight of the composition, diethylene glycol in an amount of from about 10% to about 40%, water from about 0% to about 10% and microballoons from about 0.01% to about 4% depending on the type of microballoon. The diethylene glycol may contain minor amounts of other homologous glycols.

The sodium perchlorate is added in dry, particulate or crystal form, although a minor amount also may be dissolved in the diethylene glycol and/or water. Minor amounts may be added of other inorganic oxidizer salts selected from the group consisting of ammonium, alkali and alkaline earth metal nitrates, chlorates and perchlorates.

Preferably, a thickening agent is added to the composition to influence its rheology and casting manner and time. A preferred thickener is Xanthan gum, although the thickening agent may be selected from the group consisting of galactomannan gums, biopolymer gums, guar gum of reduced molecular weight, polyacrylamide and analogous synthetic thickeners, flours and starches. Thickening agents generally are used in amounts ranging from about 0.02% to about 0.2%, but flours and starches may be employed in greater amounts, in which case they also function as fuels. Mixtures of thickening agents can be used.

The microballoons preferably are plastic microspheres having a nonpolar surface and comprising homo-, co- or terpolymers of vinyl monomers. A preferred composition of the plastic microspheres is a thermoplastic copolymer of acrylonitrile and vinylidine chloride. Additionally, the microballons may be made from siliceous (silicate-based), ceramic (alumino-silicate) glass such as soda-lime-borosilicate glass, polystyrene, perlite or mineral perlite material. Further, the surface of any of these microballoons may be modified with organic monomers or homo-, co- or terpolymers of vinyl or other monomers, or with polymers of inorganic monomers. Microballoons preferably are employed in an amount of from about 0.05% to about 1.6% by weight, and plastic microballoons preferably are employed in an amount of less than about 0.5%. Preferably, the density of the explosive composition containing microballoons is less than about 1.7 g/cc.

In the optimum preparation, the sodium perchlorate particles or crystals ("solid portion") are mixed with a solution of water (if used) and diethylene glycol ("liquid portion"), and a slurry of microballoons in diethylene glycol and water (if used) and casting agent (if used) ("second liquid portion"). The thickening agent, if used, preferably is prehydrated in the liquid portion prior to adding the other portions. Although the preferred method of formulation is to add the liquid portion and the second liquid portion separately to the solid portion, these liquid portions can be combined and then added to the solid portion. Following addition of the portions, simple mixing occurs in a manner sufficient to form a uniform slurry, which then can be poured into a desired container(s) for curing.

The curing mechanism is not fully understood, but the following is a possible explanation. During mixing, a small portion of sodium perchlorate will dissolve in the liquid portion because of the relatively high solubility of sodium perchlorate in water, and its lower but significant solubility in diethylene glycol; however, complete dissolution does not occur. Rather a slurry of solid sodium perchlorate in the liquid portion results, and this suspension may be stabilized by thickening agents if present. As the liquid portion absorbs into the sodium perchlorate particles or crystals, the mixture immediately begins to thicken further and generate heat. The water, diethylene glycol and anhydrous sodium perchlorate molecules form a sodium perchlorate monohydrate (which is a known hydrate) and a sodium perchlorate diethylene glycol solvate. (This solvate has been observed in X-ray crystallography single crystal examination.) Upon further penetration or absorption of the water and diethylene glycol molecules into the sodium perchlorate crystals, increasing amounts of hydrate and solvate are formed and the temperature of the mixture rises due to the heats of hydration and solvation generated in these processes.

The rate and degree of temperature rise depends on several factors, such as the size and configuration of the sample, how well the sample is insulated to prevent heat loss to the environment, and how fast the liquid is absorbed into the crystals. A typical temperature rise of a semi-insulated sample that cures in 40 to 70 minutes can be about 40° C. Thus the curing process can be monitored by observing the temperature rise, the time required to reach the maximum temperature rise and the time required for the mixture to cast (for the surface of the sample to become firm).

The present invention can be better understood by reference to the examples shown in Tables 1–6.

Tables 1–5 contain comparative examples between cast compositions containing microballoons and cast compositions without microballoons. Tables 1–3 contain a comparison of detonation results; Table 4 contains a comparison of casting times, i.e., the times following admixture of ingredients required to cause the compositions to cast (when the surfaces of the compositions become firm) and Table 5 contains a comparison of impact sensitivities. Table 6 contains detonation results representative of smaller-sized cast compositions containing microballons. In these tables the following key applies:

NaP=sodium perchlorate

NHCN=Norsk Hydro calcium nitrate

DEG=diethylene glycol

D,#8=detonation velocity when initiated with a No. 8 strength detonator

Table 1 illustrates the difference in run-up distances between cast compositions containing plastic microballoons and those that do not. The compositions contained Norsk Hydro calcium nitrate which acts as a casting agent. These differences in run-up distances are best seen by comparing the detonation velocities in the 50–100 mm distance segment (distance along the length of the initiated charge originating at the cap end). As can be seen, the presence of plastic microballoons significantly reduced the distance required before terminal detonation velocity was reached. Without plastic microballoons (columns 1 and 4), the terminal velocity was not reached until the 150–200 mm increment, whereas when plastic microballoons were present, the terminal velocity was reached in the 100–150 mm increment for the 50 mm diameter samples and the 50–100 mm increment for the 75 mm samples. In addition, the velocity in the 50–100 mm increment also was higher in the 50 mm diameter charges when plastic microballoons were present. Table 2 shows that the presence of plastic or glass microballoons improved the terminal velocity of cast compositions in charge diameters of 38 mm and smaller and also lowered the critical diameter.

Table 3 contains additional comparative data for cast compositions. Examination of the data again illustrates the effect on run-up distance when microballoons are present. When microballoons are present, run-up is essentially complete in the 50–100 mm segment, whereas when microballoons are not present, run-up is not complete until the 100–150 mm segment of the charge or beyond. Table 3 further shows that at every diameter tested below 38 mm the presence of microballoons improved the terminal detonation velocity of the charge. Also, Table 3 again shows the effect of microballons in reducing the critical diameter of the cast compositions.

Table 4 illustrates the advantage of including plastic or glass microballoons on the casting properties of the cast compositions. A comparison of the results shown in the table indicates that the presence of plastic microballoons dramatically increased the casting rate of the product, as evidenced by shorter cast times, higher temperature rise of the product during casting and a shorter time required to reach the maximum temperature. Glass microballoons were also effective in increasing the casting rate.

Table 5 is a comparison of impact sensitivity between a cast composition that contained plastic or glass microballoons and one that did not. The results show a reduction in sensitivity to impact when plastic microballoons were included in Example 2. As can be seen by the data in the table, the drop weight impact sensitivity was slightly reduced (an increase in $H_{50}$ from 17.40 cm to 18.49 cm) ($H_{50}$ means the height in centimeters where there is a 50 percent probability of a reaction when a 2.0 kilogram weight is dropped on approximately 20 milligrams of sample), and the bullet impact (with a 0.22 long rifle bullet) and air cannon impact sensitivity were dramatically reduced when plastic microballoons were added. (The air cannon impact test involved an apparatus which used compressed air to accelerate a charge through a barrel and impact it on a concrete surface at a fixed velocity depending on the air pressure.) When glass microballoons were added, the bullet impact sensitivity was also dramatically reduced.

Table 6 contains data representative of cast compositions containing plastic microballoons in configurations suitable for small charge applications, i.e., small boosters or primers and minihole seismic explosives (≦one pound). As shown by the data in Table 6, excellent sensitivity to initiation and detonation velocities (approximately 6000 meters/second) were obtained even in charges as small as 38 mm diameter by 89 mm long. In addition, a demonstration of the short run-up distance and explosive energy available in this product is seen by the ability of the cast composition with microballoons in a 38 mm diameter to punch a 9.5 mm steel plate, when the end of the initiating cap was only 19 mm away from the steel witness plate.

Because of the cast, solid nature of the compositions, their relatively high density and sensitivity, and other detonation parameters, they are particularly useful as a booster or primer or as a seismic explosive. In addition, the improved properties due to the presence of microballoons make these compositions ideal for use in small sizes. The cast compositions are reliably cap-sensitive.

While the present invention has been described with reference to certain illustrative examples and preferred embodiments, various modifications will be apparent to those skilled in the art and any such modifications are intended to be within the scope of the invention as set forth in the appended claims.

TABLE 1

| | 50 mm Diameter | | | 75 mm Diameter | | |
|---|---|---|---|---|---|---|
| | 1 | 2 | 3 | 4 | 5 | 6 |
| NaP | 67.90 | 67.75 | 67.70 | 67.90 | 67.75 | 67.70 |
| NHCN | 3.77 | 3.76 | 3.76 | 3.77 | 3.76 | 3.76 |
| DEG | 24.52 | 24.47 | 24.45 | 24.52 | 24.47 | 24.45 |
| $H_2O$ | 3.78 | 3.77 | 3.77 | 3.78 | 3.77 | 3.77 |
| Xanthan Gum | 0.03 | 0.03 | 0.03 | 0.03 | 0.03 | 0.03 |
| Plastic Microballoons | — | 0.22 | 0.29 | — | 0.22 | 0.29 |
| Density (g/cc) | | | | | | |
| Before Casting | 1.79 | 1.64 | 1.57 | 1.79 | 1.64 | 1.57 |
| After Casting | 1.78 | 1.59 | 1.52 | 1.78 | 1.59 | 1.52 |
| Results at 20° C. | | | | | | |
| D, #8 (km/sec) | | | | | | |
| 50–100 mm | 3.3 | 5.7 | 5.8 | 4.4 | 6.3 | 6.0 |
| 100–150 mm | 5.0 | 6.3 | 6.2 | 6.2 | 6.0 | 5.8 |
| 150–200 mm | 6.3 | 6.2 | 5.9 | 6.8 | 6.1 | 6.3 |
| 200–250 mm | 6.5 | 5.9 | 6.1 | 7.2 | 6.3 | 6.0 |
| 250–300 mm | 6.1 | 6.1 | 5.9 | 7.0 | 6.2 | 6.0 |

TABLE 2

| | 1 | 2 | 3 | 4 | 5 |
|---|---|---|---|---|---|
| NaP | 67.90 | 67.75 | 71.30 | 71.14 | 70.16 |
| NHCN | 3.77 | 3.76 | — | — | — |
| DEG | 24.52 | 24.47 | 24.67 | 24.62 | 24.62 |
| $H_2O$ | 3.78 | 3.77 | 3.99 | 3.98 | 3.98 |
| Xanthan Gum | 0.03 | 0.03 | 0.04 | 0.04 | 0.04 |
| Plastic microballoons | — | 0.22 | — | 0.22 | — |
| Glass microballoons | — | — | — | — | 1.20 |
| Oxygen Balance (%) | −0.01 | −0.39 | +0.02 | −0.37 | −0.51 |
| Density (g/cc) | 1.74 | 1.57 | 1.78 | 1.57 | 1.60 |
| Results at 20° C. | | | | | |
| MB, 75 mm, Det/Fail | | | | | |
| Cap | #1/#0.5 | #0.5/— | #0.5/— | #1/#0.5 | #1/#0.5 |
| Cord | 7.5 gr/4 gr | 7.5 gr/4 gr | — | — | — |
| $d_c$, Det/Fail (mm) | 19/12 | 12/— | 19/12 | 12/— | 12/— |
| D, #8 (km/sec) | | | | | |
| 75 mm | 6.4 | 6.2 | — | 6.3 | 6.3 |
| 63 mm | 6.1 | 6.1 | — | — | 6.3 |
| 50 mm | 6.2 | 6.1 | 6.3 | 6.3 | 6.0 |
| 38 mm | 4.9 | 5.8 | 6.0 | 6.2 | 5.9 |
| 32 mm | 4.3 | 5.6 | 5.6 | 5.9 | 5.7 |
| 22 mm | 4.0 | 5.3 | 5.2 | 5.5 | 5.4 |
| 19 mm | 3.1 | 4.9 | 4.4 | 5.2 | 5.0 |
| 12 mm | Fail | Det | Fail | 4.4 | 4.2 |

TABLE 3

| | 50 mm Diameter | | | 38 mm | | 32 mm | | 25 mm | | 19 mm | | 12 mm | |
|---|---|---|---|---|---|---|---|---|---|---|---|---|---|
| | 1 | 2 | 3 | 4 | 5 | 6 | 7 | 8 | 9 | 10 | 11 | 12 | 13 |
| NaP | 71.30 | 71.14 | 70.16 | 71.30 | 71.14 | 71.30 | 71.14 | 71.30 | 71.14 | 71.30 | 71.14 | 71.30 | 71.14 |
| DEG | 24.67 | 24.62 | 24.62 | 24.67 | 24.62 | 24.67 | 24.62 | 24.67 | 24.62 | 24.67 | 24.62 | 24.67 | 24.62 |
| $H_2O$ | 3.99 | 3.98 | 3.98 | 3.99 | 3.98 | 3.99 | 3.98 | 3.99 | 3.98 | 3.99 | 3.98 | 3.99 | 3.98 |
| Xanthan Gum | 0.04 | 0.04 | 0.04 | 0.04 | 0.04 | 0.04 | 0.04 | 0.04 | 0.04 | 0.04 | 0.04 | 0.04 | 0.04 |
| Plastic Microballoons | — | 0.22 | — | — | 0.22 | — | 0.22 | — | 0.22 | — | 0.22 | — | 0.22 |
| Glass Microballoons | — | — | 1.20 | — | — | — | — | — | — | — | — | — | — |
| Results at 20° C. | | | | | | | | | | | | | |
| D, Posidet (km/sec) | | | | | | | | | | | | | |
| 50–100 mm | 5.4 | 6.2 | 6.2 | 5.0 | 5.9 | 4.6 | 5.6 | 4.2 | 5.4 | 4.1 | 5.0 | Fail | 4.3 |
| 75–125 mm | 5.4 | 6.1 | 6.1 | 5.3 | 6.0 | 5.0 | 5.8 | 4.5 | 5.5 | 4.1 | 5.1 | Fail | 4.4 |
| 100–150 mm | 5.9 | 6.3 | 6.2 | 5.6 | 6.3 | 5.1 | 5.9 | 4.9 | 5.3 | 4.3 | 5.1 | Fail | 4.2 |
| 125–175 mm | 6.1 | 6.4 | 6.2 | 5.8 | 6.1 | 5.5 | 6.0 | 5.0 | 5.5 | 4.3 | 5.2 | Fail | 4.5 |
| 150–200 mm | 6.4 | 6.2 | 6.3 | 6.1 | 6.1 | 5.6 | 5.9 | 5.3 | 5.6 | 4.5 | 5.2 | Fail | 4.3 |
| 175–225 mm | 6.5 | 6.3 | 6.4 | 6.1 | 6.2 | 5.8 | 5.9 | 5.2 | 5.6 | 4.4 | 5.3 | Fail | 4.4 |
| Average of 3 points (125–225 mm) | 6.3 | — | — | 6.0 | — | 5.6 | — | 5.2 | — | 4.4 | — | Fail | — |
| Average of 5 points (75–225 mm) | — | 6.3 | 6.2 | — | 6.2 | — | 5.9 | — | 5.5 | — | 5.2 | — | 4.4 |

TABLE 4

| | 1 | 2 | 3 | 4 | 5 |
|---|---|---|---|---|---|
| NaP | 71.30 | 70.98 | 71.30 | 70.98 | 70.34 |
| DEG | 24.67 | 24.56 | 25.33 | 25.21 | 24.11 |
| $H_2O$ | 3.99 | 3.97 | 3.33 | 3.32 | 3.91 |
| Xantham Gum | 0.04 | 0.04 | 0.04 | 0.04 | 0.04 |
| Plastic Microballoons | — | 0.45 | — | 0.45 | — |
| Glass Microballoons | — | — | — | — | 1.60 |
| Density (g/cc) | 1.75 | 1.38 | 1.67 | 1.42 | 1.54 |
| Results | | | | | |
| Cast Time (min)* | 25.5 | 5.0 | 55.5 | 9.5 | 19.0 |
| Temperature Rise ΔT(°C.) | 22.1 | 40.1 | 10.9 | 40.6 | 33.9 |
| Time to Max Temp. Rise (Hours) | 1.23 | 0.33 | >2.00 | 0.57 | 0.66 |

*Surface of sample is firm.

TABLE 5

| | 1 | 2 | 3 |
|---|---|---|---|
| NaP | 71.30 | 71.18 | 70.16 |
| DEG | 24.67 | 24.62 | 24.62 |
| $H_2O$ | 3.99 | 3.98 | 3.98 |
| Xanthan Gum | 0.04 | 0.04 | 0.04 |
| Plastic microballoons | — | 0.18 | — |
| Glass microballoons | — | — | 1.20 |
| Results at 20° C.: | | | |
| Drop Weight Test (cm) | | | |
| $H_{50}$ | 17.40 | 18.49 | 12.83 |
| $H_{min}$ | 15.24 | 15.24 | 10.16 |
| Friction Test | | | |
| Minimum Loan (kg)[1] | 16.0 | 16.0 | 8.0 |
| Trials Required for Positive Test | 4 | 5 | 1 |
| Bullet Impact Test[2] | | | |
| .22 Long Rifle (135 Joules)[3] | | | |
| Det | 12 | 4 | 5 |
| Reaction | 20 | 0 | 1 |
| Fail | 8 | 56 | 34 |
| Trials | 40 | 60 | 40 |

TABLE 5-continued

| | 1 | 2 | 3 |
|---|---|---|---|
| .22/250 (1765 Joules)[3] | | | |
| Det | 4 | 6 | — |
| Reaction | 6 | 0 | — |
| Fail | 1 | 0 | — |
| Trials | 10 | 6 | — |
| Air Cannon Test (200–280 psi)[2] | | | |
| Det | 34 | 2 | 12 |
| Reaction | 0 | 2 | 0 |
| Fail | 87 | 56 | 28 |
| Trials | 121 | 60 | 40 |

[1]Minimum load in kilograms required for at least one positive result in six trials.
[2]910 grams, 75 mm diameter size charges.
[3]Impact energy.

TABLE 6

| | 1 | 2 | 3 |
|---|---|---|---|
| NaP | 71.12 | 71.12 | 71.12 |
| DEG | 24.62 | 24.62 | 24.62 |
| $H_2O$ | 3.98 | 3.98 | 3.98 |
| Xanthan Gum | 0.04 | 0.04 | 0.04 |
| Plastic Microballoons | 0.24 | 0.24 | 0.24 |
| Density (g/cc) | 1.60 | 1.65 | 1.59 |
| Charge Size | | | |
| Weight (g)[1] | 162 | 335 | 478 |
| Diameter (mm) | 38 | 38 | 50 |
| Length (mm) | 89 | 178 | 160 |
| Results at 20° C. | | | |
| MB (Det/Fail) | #0.5/— | #0.5/— | #1/#0.5 |
| D, Posidet (km/sec) | 6.0 | 6.2 | 6.4 |
| Plate Punch Test[2] | | | |
| Cap Up[3] (size hole, mm) | 25.4 × 9.5 | 25.4 × 25.4 | 25.4 × 25.4 |
| Cap Down[4] (size hole, mm) | 31.8 × 6.4 | 31.8 × 25.4 | 31.8 × 31.8 |
| Distance End of Cap From Plate (mm) | 19 | 108 | 90 |

[1]Average of twenty charges.
[2]9.5 mm steel plate.
[3]Initiating cap pointed away from plate (end of cap 70 mm from plate).
[4]Initiating cap pointed toward plate.

What is claimed is:

1. A cap-sensitive, cast, solid explosive composition having reduced impact sensitivity and consisting essentially of from about 50% to about 80% by weight sodium perchlorate, from about 10% to about 40% diethylene glycol, from about 0% to about 10% water and from about 0.01% to about 4% microballoons, with the amount of microballons being effective to reduce the impact sensitivity of the composition.

2. A composition according to claim 1 wherein the microballoons are selected from the group consisting of glass, plastic, perlite, polystyrene, ceramic and mineral.

3. A composition according to claim 2 wherein the microballoons are plastic.

4. A composition according to claim 3 wherein the microballoons have their surface modified with organic or inorganic polymer coatings.

5. A composition according to claim 1, additionally consisting essentially of a thickening agent.

6. A composition according to claim 1, wherein the microballoons are present in an amount of from about 0.05 to about 1.6% by weight.

7. A composition according to claim 1 having a density of less than about 1.7 g/cc.

8. A composition according to claim 3 wherein the plastic microballoons are present in an amount of less than about 0.5%.

* * * * *